United States Patent [19]

Rodesch et al.

[11] 4,099,722

[45] Jul. 11, 1978

[54] ELECTRONIC SLOT MACHINE

[75] Inventors: Dale F. Rodesch; George E. Johnson, both of Las Vegas, Nev.

[73] Assignee: Centronics Data Computer Corp., Hudson, N.H.

[21] Appl. No.: 600,209

[22] Filed: Jul. 30, 1975

[51] Int. Cl.[2] ..... A63F 5/04

[52] U.S. Cl. ..... 273/143 R; 194/97 R; 340/635

[58] Field of Search ..... 194/1 M, 1 N, 1 E, 1 G, 194/97 R, 102, DIG. 1; 273/1 E, 138 A, 139, 143 R, 143 B, 143 C, DIG. 28, 85 R; 235/92 GA, 92 CN, 92 EA; 340/323 R, 324 AD, 172.5; 364/200, 900

[56] References Cited

U.S. PATENT DOCUMENTS

| | | | |
|---|---|---|---|
| 3,439,281 | 4/1969 | McGuire et al. | 273/138 A X |
| 3,590,223 | 6/1971 | Cake | 235/92 CN |
| 3,606,337 | 9/1971 | Larsen et al. | 273/143 R |
| 3,684,290 | 8/1972 | Wayne | 273/143 C |
| 3,876,208 | 4/1975 | Wachtler et al. | 273/1 E X |
| 3,913,922 | 10/1975 | Richards et al. | 273/143 R |
| 3,918,716 | 11/1975 | Nonaka et al. | 273/138 A |
| 3,929,338 | 12/1975 | Busch | 273/138 A |

FOREIGN PATENT DOCUMENTS

| | | | |
|---|---|---|---|
| 962,770 | 2/1975 | Canada | 194/1 G |
| 1,252,259 | 11/1971 | United Kingdom | 273/138 A |
| 1,178,302 | 1/1970 | United Kingdom | 273/138 A |
| 1,107,552 | 3/1968 | United Kingdom | 273/138 A |

*Primary Examiner*—Richard C. Pinkham
*Assistant Examiner*—Vance Y. Hum
*Attorney, Agent, or Firm*—Louis Weinstein

[57] ABSTRACT

An electronic slot machine employing solid state circuitry of modular design, simplifying maintenance to the tasks of module replacement, changing lamps and possibly clearing a coin jam. A coin detector creates a jam condition upon any malfunction during coin insertion. A high frequency clock drives a multistage counter which is decoupled from the clock either upon insertion of the proper number of coins (in an automatic machine) or upon the operation of the conventional operating handle which is activated by coin entry. A stepping motor steps the reels, having a plurality of symbols, while stepping the count in the counter to zero, which count deenergizes the stepping motors. Three-bit binary codes are generated representing the reel symbols in the final output position for any type of machine from three symbol center line to five line criss-cross models. Logical gates decode the symbol combination indicating a payout (if any) and size of payout which is stored in counter means stepped downwardly as coins are dispensed. Test routines and security and function evaluation (SAFE) circuitry are provided to assure proper operation and to positively identify the malfunction, which is presented on a visual display. Malfunctions or security breaches are checked and lock the machine and flash a malfunction lamp, the malfunctions being isolated and identified by visual display. Machine identification number, coin quantities, payouts and malfunctions are stored and polled by computer which extracts machine status, security breach, malfunction, security breach, coin handle, coin drop and other coin flow data.

24 Claims, 11 Drawing Figures

FIG. 1.
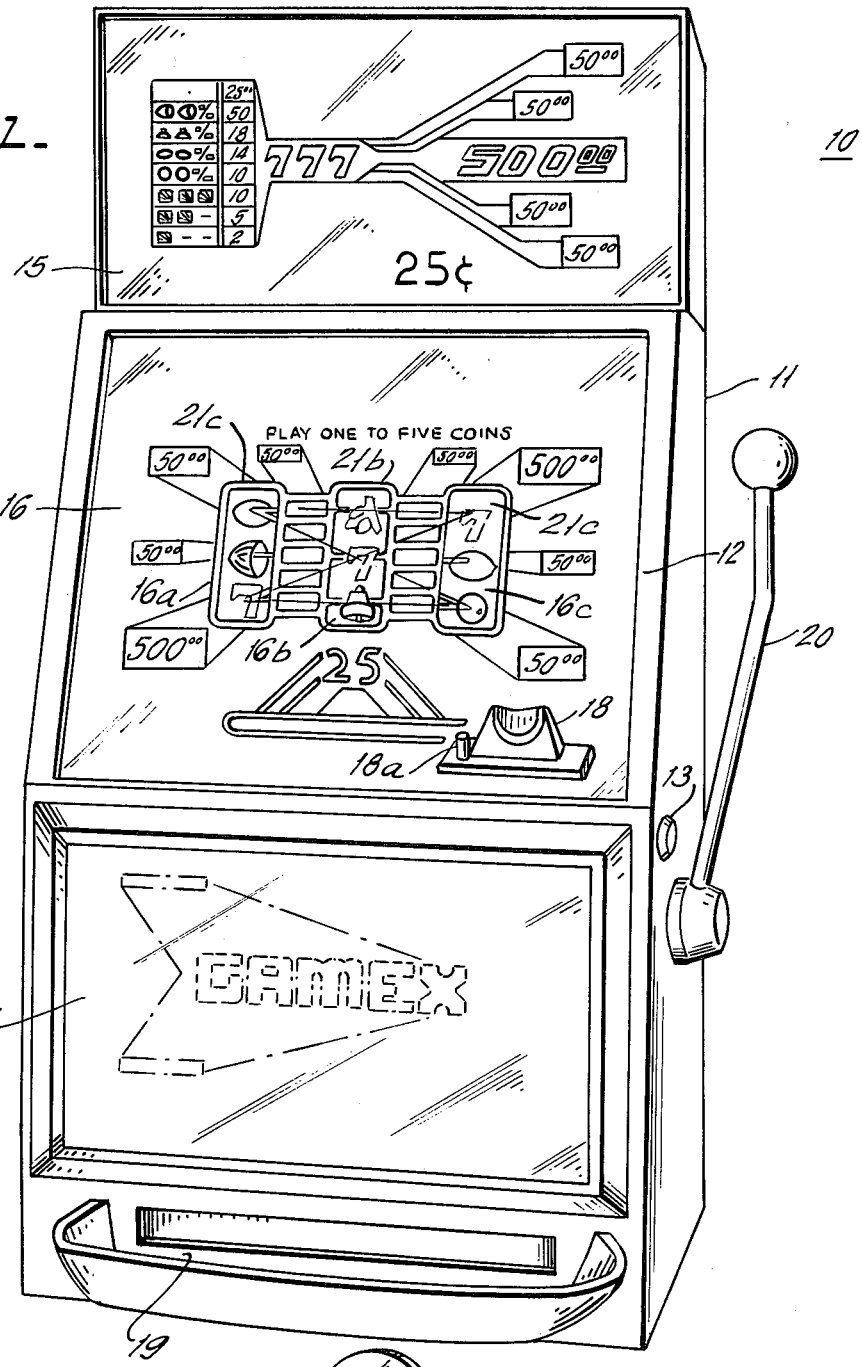
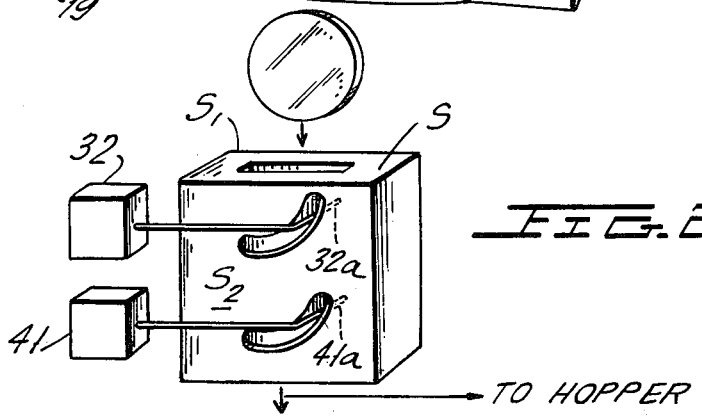
FIG. 2a.

HANDLE
HOPPER RUN SENSE
COIN IN STROBE
COUNT DOWN
END REEL DRIVE
TEST
SYMBOL DISABLE
HOPPER ON
END REEL DRIVE
FLASHER FAST
100 MS
BONUS LIGHT
PAY OPTION
NO PAY
JACK POT OPTIONS
MAX COIN
HI PAY SWITCHED
HI PAY UNSWITCHED
SAFE PAYOUT
BONUS PAY
JP#2 LAMP
JP#1 LAMP
JP#1
COINS PAID COUNTER
OVER PAY
ANY LEMON
COIN COUNTER=0
COIN PAID RESET
PAY OPTION
COIN COUNTERS
OSM 70
OSM 175
FF 295
+5

ELECTRONIC SLOT MACHINE

BACKGROUND OF THE INVENTION

The present invention relates to slot machines and more particularly to a novel modular solid state slot machine for performing all machine functions through novel solid state circuitry.

Heretofore, slot machines were generally of mechanical or at most electromechanical design wherein the deposit of a coin enabled activation of the machine. The operation of the machine operating arm caused rotation of each of the three (or more) display wheels freewheelingly mounted upon a common shaft and each containing the same indicia, which indicia, when lined up in rows or diagonally in predetermined combinations indicate either a winning condition or a non-winning condition. Due to the large number of repeated operations required by mechanical components such machines require frequent maintenance and repair. The anti-cheat and anti-theft mechanisms of the prior art have also been found to be ineffective.

BRIEF DESCRIPTION OF THE INVENTION

The present invention is characterized by providing a novel all-electronic slot machine which utilizes high speed solid state electronic circuitry for performing all of the functions heretofore performed by mechanical and/or electro-mechanical components utilized in conventional slot machines. In addition thereto, capabilities well beyond those provided in existing equipment are obtained thereby yielding a slot machine in which the need for maintenance and/or repair is significantly reduced and is further significantly simplified as compared with present day devices. Many types of electronic games have been developed and some of these resemble a slot machine. The present invention relates to a machine where coins are inserted, a handle is pulled, symbol bearing reels visible through front viewing glass rotate and randomly stop in some predetermined order, identifiable winning combinations which are clearly marked pay back coins automatically, the entire process requiring an average of about five 5 seconds.

The machine of the present invention tests each coin for size, weight and metal content and a safe drop starts a counter which may accumulate up to five coins for a multi-line, multi-coin machine. Any tampering with the coin entry sensors is detected, the machine locks in a non-playable condition, and a visual (audible if desired) indication is provided. After at least one coin is accepted, the handle pull circuit is enabled to decouple the output of a random generator from a counter provided for each reel upon a valid handle pull operation, to store a predetermined count. Malfunction monitoring means generates a random generator malfunction signal in the event of a random generator malfunction. The reels are then activated. The motor driven reels are continually tested for proper speed of rotation. After a predetermined minimum run time, the counters are stepped to zero to halt each reel. Photosensing means sense the symbols for each reel by sensing the hole patterns. These code combinations are decoded to determine the presence (or absence) of a winning combination. Any half-step rotation of a reel is detected as a malfunction condition. The sensing means also serves as an input to detection means to generate a reel malfunction signal in the event of malfunction of any one of the reels. The count of the selected payout combination is stored in a counter which is stepped as each coin is dispensed into the payout tray. An over pay, hopper jam or no payout in the presence of a winning combination, develops a malfunction signal. For multiple line machines, each separate line is decoded in sequence. Combinations for attendant payout are provided as options. All machine functions are monitored on a regular basis to check for malfunctions. All malfunctions are stored in a memory together with coin in-take, coin payout, door open, hopper jam, power failure, etc. All of the stored data is available for polling and print-out by a computer which identifies each machine by its machine code number. Only the machine having that code number will respond and output all of its stored data. In the case of malfunctions a flashing lamp observable from the exterior of the machine, and/or audible devices, and/or blackout of lamp circuits identifies a machine malfunction while an internally mounted LED display isolates the exact cause of malfunction. All circuits are modular making maintenance a simple matter to replacing the defective module. All options are provided in every machine with the selected options being a simple matter of making the proper jumper connections.

It is therefore one object of the invention to provide a novel solid state gaming machine.

Another object is to provide a gaming machine having self-checking circuitry for continuously monitoring all machine functions and states to signal a malfunction condition and to precisely indicate the nature of the malfunction by means of a low energy lamp display.

Another object of the invention is to provide a solid state gaming machine having solid state means for generating output combinations in a truly random fashion.

Still another object is to provide a gaming machine for storing all machine states and adapted to be periodically polled to provide malfunction, accounting and statistical data to a communications link for data processing and/or data print-out.

Another object of the present invention is to provided a gaming machine having novel independently operated reel assemblies and a stepper motor electronically and randomly stepped to a final stop position by electronic control circuitry.

BRIEF DESCRIPTION OF THE DRAWINGS

The above, as well as other objects of the invention will become apparent from the accompanying description and drawings, in which:

FIG. 1 is a perspective view of a gaming machine embodying the principles of the present invention.

Figure 2:
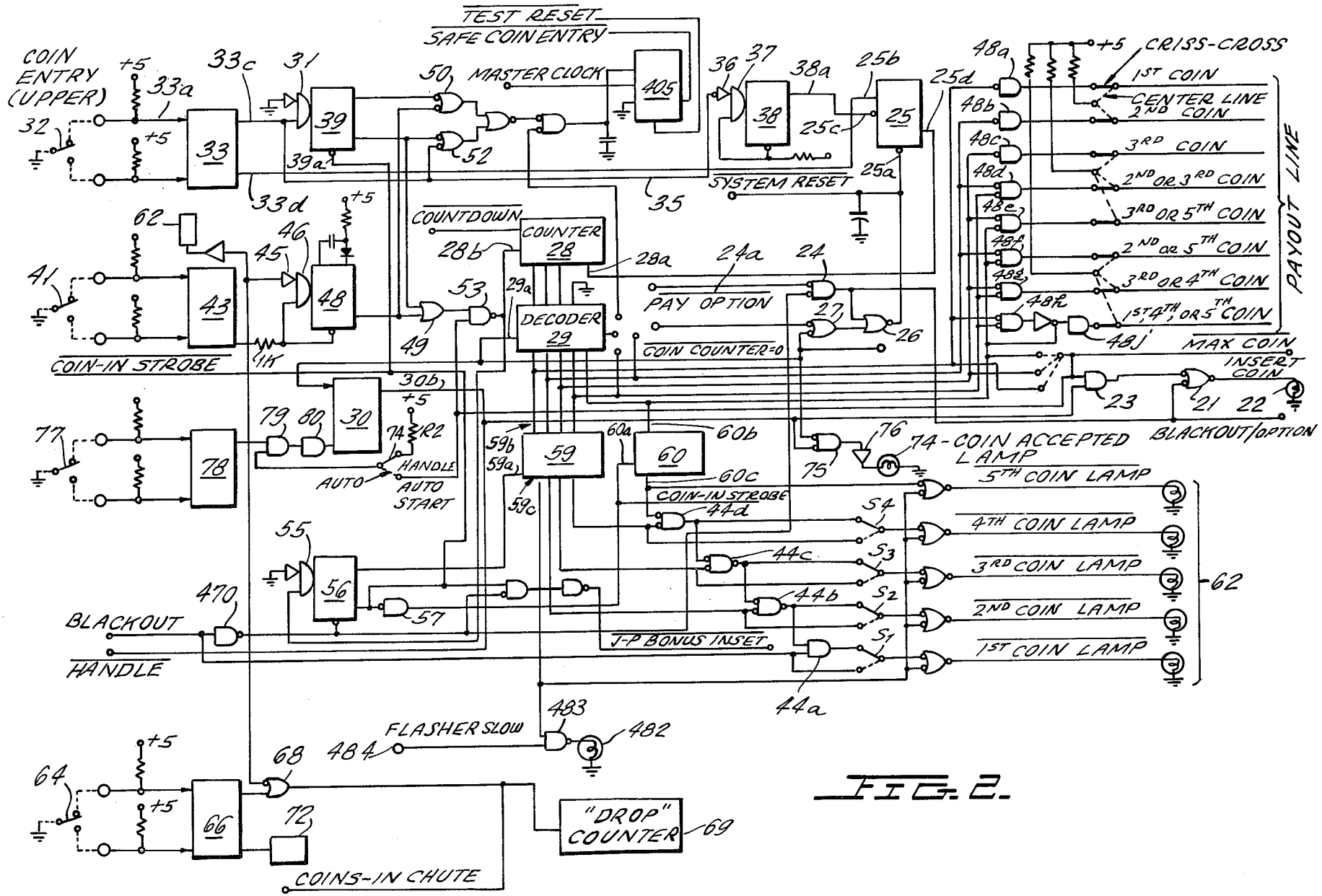
FIGS. 2–5, *6d* and 7 are schematic diagrams of the electronic circuitry employed in the operation of the machine of FIG. 1.

FIG. *2a* is a perspective view of a coin acceptor employed in the machine of FIG. 1.

FIGS. *6a–6c* show perspective views of one of the reel assemblies employed in the gaming machine of FIG. 1.

DETAILED DESCRIPTION OF THE INVENTION

FIG. 1 is a perspective view showing a slot machine 10 embodying the principles of the present invention and which is comprised of a fully enclosed tamperproof housing 11 having a hinged front door 12 normally maintained in the closed and locked position by key-operated lock 13. The front face of the machine is comprised of an upper award display panel 15, a large centrally located reel display 16 and a lower casino advertising display panel 17. A coin entry slot is provided on the front face at 18 and includes a manually operable coin release button 18*a*. Drop tray 19 is provided at the bottom front face of housing 11 for payout in case of a win or coin return. Handle 20 is provided to place the machine into operation after deposit of the requisite number of coins. In alternative embodiments, handle 20 may be eliminated and the activation of the reels may be provided immediately upon deposit of a single coin or the requisite number of coins, as the case may be.

Upper panel 15 is provided with lamps behind each of the winning combinations. The amount of coins played may be selectively illuminated to show increased awards. Central display panel 16 is provided with three transparent windows 16*a*, 16*b* and 16*c* behind which each of the reels 21*a*, 21*b* and 21*c* is positioned. In the embodiment shown in FIG. 1, a "criss-cross" type of machine is depicted wherein winning combinations may be obtained across three horizontal lines labelled "Line 1" (center line); "Line 2"](upper line); and "Line 3" (bottom line); and which further provides for two diagonal combinations labelled "Line 4" (upper left to lower right); and "Line 5" (lower left to upper right). Thus, it is possible to yield as many as five different combinations on a single play of the machine. In such instances, and in order to play five combinations, the machine has a capability of accepting predetermined quantities of coins for each such combination play, as well as having a capability of being activated for only a single line play or a multiple line play of less than the maximum number of lines (in the present case, five lines). All winning combinations (in the event that more than one winning event occurs) can be added together and the total amount paid.

The reels 21*a*–21*c* which are visible behind windows 16*a*–16*c* respectively and have their exteriors illuminated by suitable lamp means (not shown) are each typically provided with indicia (for example, "fruit"-symbols) which set up the various permutations and combinations of winning (and non-winning) plays.

Pulling handle 20 activates a switch sensor (not shown in FIG. 1) as opposed to conventional devices in which mechanical components react thereto to place the machine into play by mechanically "kicking" the reels into rotation. The handle, however, is designed to have a conventional handle "feel" .

Modular construction is used throughout the machine and the extra large capacity tray 19 is designed to slide out on guide rails. All of the internal electronics utilize only D.C. voltage and there is no A.C. wiring within the machine.

Reels 21*a*–21*c* are individually removable with the same guide rail, self-seating plus arrangement. The reels are preferably formed of plastic and are driven by maintenance-free stepping motors. There are no metal on metal constacts to wear and no lubrication and periodic maintenance of any kind to be performed. No adjustments are provided in the machine and maintenance is a simple matter of module replacement, lamp changing and insofar as mechanical aspects are concerned, the possiblity of clearing a coin jam.

Positioned behind reels 21*a* –21*c* is the internal computer printed circuit board package which is universal in nature for all machine models and the options provided are selectable by jumper wires provided on the board making model or option conversion a simple activity when required. Included within the computer electronics (to be more fully described) is a truly random generator which guarantees yield for the life of the machine.

A security alert and function evaluator (SAFE) display is provided within the machine wherein sensors throughout the machine and circuitry within the computer continually check for malfunctions or a security breach. If such should occur, the machine will lock in a non-playable condition, a flashing light on the top of the display will indicate a malfunction and by gaining access to the interior of the housing observation of the "SAFE" display (comprised of light emitting diodes, i.e. LED's) immediately isolates the specific malfunction.

Basic models include one, three and five coin machines of any denomination; center line (Line 1) only pay but for provision for bars in any position; three line (Lines 1–3) and five line (Lines 1–5) criss-cross models, standard bell fruit; fruit symbols with one cherry paying two or three; jackpot-only machines with three different symbols and blanks or with seven symbols without blanks and blanks or a combination of symbols to pay; and a one symbol wild model. Options include a top candle, various bells and chime arrangements, automatic reel start when maximum number of coins are inserted or a handleless single coin machine. Several configurations for non-linear or attendant pays including a double progressive machine is also provided and any model can be provided with an option where each display reel randomly steps in either direction on each handle pull.

The machine of FIG. 1 is equipped to interface with a mini-computer wherein a three-wire transmission line is daisy-chained from the computer to the slot machines. Each machine has a different address and a decoder is provided in the machine to decode that address. A central mini-computer may be utilized to poll each slot machine in sequence to extract data as to machine status, cause of malfunction (if any), security breaches and coin totals and coin handle and coin drop counts. Immediate security alerts are provided, several types of maintenance reports are available on demand or automatically and a management summary by machine with floor totals is available. All of the above information may be printed out in hard copy form.

Turning to a consideration of FIG. 2, when a coin is inserted in slot 18 (FIG. 1) it falls through a coin acceptor which checks the deposited coin for size, weight and non-ferrous material. If the coin does not meet the standards, it either locks within the acceptor or falls through into the payout tray. A locked up coin may be released by manually pushing the coin reject button 18*a*. The coin acceptor is a standard item which is conventional in such present day machines and a detailed description thereof will be omitted herein for purposes of simplicity. The acceptor is provided with a fail-safe solenoid which is normally deenergized and must be energized in order to accept the coin. This solenoid is energized whenever the "insert coin" condition (i.e. lamp) is present.

The insert coin condition is developed at the output of gate 21 (FIG. 2) and goes low to illuminate the insert coin lamp 22. The lamp is extinguished under the following logic conditions:

a. When the maximum number of coins for the machine has been inserted. This condition is applied to one input of gate 23 causing the output of gate 23 and the output of gate 21 to go high.

b. From the time that at least one coin has been accepted and the machine handle is pulled until payout, if any, is complete. This condition is sensed by the remaining input of gate 23 wherein the fact that the handle is activated is derived from flip-flop circuit 30, to be more fully described.

c. A "blackout" condition is present (indicating any one or more of the malfunctions), which condition is applied to the remaining input of gate 21, or d. A "bonus" condition, which is derived from the output of gate 24 in the case where an attendant pay is provided, which option (PAY OPTION) may be installed and which is coupled to input 24*a* of gate 24.

Thus, when any of the above four conditions occur, the acceptor solenoid (which is coupled to the output of gate 21) is not energized and any coins inserted into coin slot 18 fall directly through the acceptor into the payout tray. The output of gate 24 is also coupled to gate 26 causing FF 25 to be cleared. This sets the $\overline{Q}$ output 25*d* high to clear coin counter 28 to zero, preventing a reel driving and hence a payout cycle. When the coin counter 28 is set to zero by FF 25 or as a result of being counted down to zero during a payout cycle, its zero output is decoded by decoder 29 causing gate 27 to also cause gate 26 to clear FF 25. Also, after each payout is complete one-shot 154 (FIG. 4) is triggered. 100 milliseconds later one-shot 154 resets itself. During the 100 millisecond time interval (before one-shot 154 is reset) the coin counter will not count coins until the delay interval is terminated.

The SYSTEM RESET signal is generated by the output of gate 26 and causes gate 730 to turn off the hopper motor.

The BLACKOUT/OPTION line may be wired to the gate 735 (FIG. 3) to operate LED 454.

Coins which meet the standards of the acceptor fall along a path which includes a double microswitch (or double photocell) arrangement for releasing a static eliminator clamp circuit and, if the timing is correct, registers as a valid coin. The computer inputs are buffered into flip-flop circuits for subsequent transfer to the computer during a computer scan operation as will be more fully described.

The static eliminator comprises bistable flip-flop 25 which is clamped in the clear condition at its input 25*a* if a blackout condition is present (and is applied to 25*a* through gate 26) or if the bonus option is activated, said option condition being applied through gates 24 and 26 to "clear" input 25*a*. Flip-flop 25 is momentarily cleared at the end of every pay cycle, which condition is provided at one input of gate 27 and is coupled to input 25*a* through gate 26. In the cleared condition, flip-flop 25 applies its $\overline{Q}$ output 25*d*, which is high at this time, to the clear input 28*a* of multistage electronic counter 28. The high condition at output 25*d* is sustained to prevent counter 28 from counting until the clear condition at 28*a* is released.

At this time, and when the output of counter 28 is at zero, this condition is decoded by decoder 29, which decodes binary codes from counter 28 into a "low" condition at an associated one of its outputs. The "zero" output 29*a* goes low to set a bistable flip-flop (FF) 30, whose output 30*a* goes high to disable the "handle" circuit and to either directly or indirectly reset or lock all of the machine timing.

When the coin passes the accepter, it falls into the coin receiving slot S (FIG. 2*a*). A top coin entry microswitch 32 having a feeler arm 32*a* is engaged by the coin to set a flip-flop 33. The Q output 33*c* of FF 33 is applied through line 35 to inverter 36 and gate 37 to trigger a one-shot multivibrator (OSM) 38 which develops a 15 millisecond pulse at its output 38*a*. This pulse is applied to the clock input 25*c* of bistable flip-flop 25. The $\overline{Q}$ output 33*d* of FF 33 is applied to the "J" input 25*b* of bistable FF 25 causing its $\overline{Q}$ output 25*d* to go low. This condition releases the locking function and also removes the clear condition from counter 28 enabling the coin counter to be incremented. If, during this cycle, static or any other conditions should cause a spike of electrical noise sufficient to affect the system ground plane, this condition will be immediately recognized by capacitor C1 (FIG. 3) which is coupled to gate 37 and to +5 volts D.C. through resistor R1. A low condition will be developed at the output of gate 37 simulating a momentary power failure which develops a "blackout" condition. As will be more fully described, the system logic, in the presence of a blackout condition, performs a 1 second check of itself, and if no malfunction is thereafter discovered (i.e. if the power failure was transient in nature), the blackout condition is released. The machine is playable, but bistable flip-flop 25 is cleared through gate 26 aborting the cycle and preventing any payout.

When a coin passes beyond the feeler 32*a* (FIG. 2*a*) of top microswitch 32, one-shot multivibrator 39 is triggered through FF 33 and gate 31 to develop a pulse of 150 millisecond duration. After passing the feeler arm of microswitch 32, the coin engages the feeler arm of 41*a* lower microswitch 41 which sets a bistable flip-flop (FF) 43. The output of FF 43 is coupled through the inverter 45 and gate 46 to trigger a 10 millisecond one-shot multivibrator 48. The $\overline{Q}$ outputs of multivibrators 39 and 48 are coupled to respective inputs of gate 49. The Q output of one-shot 39 and the $\overline{Q}$ output of one-shot 48 are coupled to the respective inputs of gate 50. The $\overline{Q}$ output of one-shot 39 and the $\overline{Q}$ output 33*d* of FF 33 are coupled to respective inputs of gate 52. The 10 millisecond duration of one-shot 48 falls within the 150 millisecond envelope of one-shot 39 to enable gate 49 which couples a count pulse through gate 53 to the upcount input 28*b* of coin counter 28 to register the deposited coin as a valid one. Any attempt to draw the coin out of the slot S will be thwarted as a result of the free ends 32*b* and 41*b* of swingable feeler arms being positioned across the slot to prevent upward movement and hence removal of the coin(s). Incorrect timing, attempts to retrigger the envelope, or stepping of the coin counter beyond its counting limit serves to cause a "blackout-coin entry" condition to be described later.

The feeler arms 32*a* and 41*a* and associated microswitches 32 and 41 may each be replaced by a light source positioned adjacent one side $S_1$ of slot S and a photocell positioned adjacent opposite side $S_2$. Light shining through an opening (not shown) in side $S_1$ normally illuminates its associated photocell. When a coin enters the slot the light paths of the light source photocell assemblies are selectively blocked causing the upper and then the lower photocell to alter their outputs which are used to trigger OSM 39 and OSM 48 in the same manner as microswitches 32 and 41 to assure proper insertion of each coin. The coin exit, door open, handle and hopper coin float microswitches may all be replaced by similar photosensing means.

Proper timing causes a valid coin to increment coin counter 28 by one count through gate 53. The output of gate 53 is further coupled through gate 55 to one-shot 56 which generates a one microsecond strobe at its Q output. The $\overline{Q}$ output of one-shot 56 is inverted at 57 and the inverted $\overline{Q}$ output appearing at the output of inverter 57 is applied to the strobe inputs 59*a* and 60*a* of latch memories 59 and 60. The plural inputs 59*b* and 60*b* of latch memories 59 and 60 store whatever decoded condition selectively appears at one of the outputs of decoder 29. However, the conditions at the inputs 59*b* and 60*b* appear at the outputs 59*c* and 60*c* only upon the occurrence of a strobe pulse. The presence of the strobe pulse causes the decoded condition at the output of decoder 29 to appear at the outputs 59*c* and 60*c* to selectively enable that lamp of the lamp group 62 which represents the number of valid coins accepted as of that time. For example, gates 474–477 light the 1st through 4th coin lamps (when switches $S_1$–$S_4$ are in the dotted line position and there is no "blackout condition"), and gate 473 lights the 5th coin lamp. When switches $S_1$–$S_4$ are in the solid line position, gates 44*a*–44*d* serve to light all lamps representing coins lower in number than the highest number coin inserted. For example, if three coins have been inserted, the lamps for coins #1, #2 and #3 will all be lit. Coin counter 29 is down counted during the pay cycle in a manner to be more fully described. Latches 59 and 60 are only affected during coin entry and are not altered by blackout. After the machine has been played, the coin lamps will continue to indicate how many coins were last played. A center line, multiple coin machine will have only one coin lamp on at any given time. A multiple line machine will have all the lines played on illuminated. Gates 48*a*–48*j* decode the number of coins counted to selectively enable the lines 180*a*–180*h* (FIG. 7) to select the lines played (as will be more fully described). The number of coins for one handle play may be increased beyond five if desired.

The coin-in strobe developed at the $\overline{Q}$ output of one-shot 56 is applied to the clear input 39*a* of one-shot 39 to abruptly abort the 150 millisecond timing cycle and thereby prepare for receipt of another coin in the event of a fast feed by the machine user on multiple coin machines. This strobe condition is further applied to input 65*a* of a multistage electronic counter 65 (FIG. 3) which is preferably a 12-bit electronic binary counter capable of developing a count of $2^{12}$ for accumulating a count of the numbe of coins deposited in the machine and is employed for computer scanning and data gathering in a manner to be more fully described. The coin-in strobe is further employed to abort a hopper timing cycle by applying a signal to the clear input of one-shot multivibrator 70 (FIG. 4) which functions in a manner to be more fully described.

The engagement of lower coin microswitch 41 (FIG. 2) is further taken from the Q output of FF 43 for use in coin counting. The output of FF 43 is coupled through inverter 61 to an electromechanical "coin-in" counter 62.

As coins are deposited in the coin hopper, a microswitch 64 sets a bistable flip-flop 66 when the hopper is filled to capacity to enable gate 68 to pass coin count pulses to a second electromechanical counter 69 referred to as the "drop" counter.

Beneath the coin entry microswitches 32 and 41 is a conventional diverter assembly typically provided with a solenoid having an arm for directing coins either to the hopper or to the drop chute. As was referred to hereinabove, the hopper is equipped with a level sensing microswitch 64 buffered by the flip-flop (FF) 66.

When the hopper is filled to a predetermined level, nominally 1000 coins, the output of FF 66 enables the drop counter 68 and simultaneously enables a hopper solenoid (not shown) coupled to the output of gate 71, which solenoid, when engaged, diverts incoming coins into the drop chute. This solenoid is of the fail-safe type to permit coins to drop to the hopper which is provided with an emergency overflow into the drop chute.

When the first coin has been accepted, the coin accepted lamp 74, coupled to the output of gate 75, is illuminated when the decoder 29 indicates that the count is greater than zero (i.e. output 29*a* is high) and the handle has yet to be operated. This causes the output of gate 75 to go low, which condition is inverted at 76 to illuminate lamp 74. At this time the handle circuit is enabled. The handle may now be pulled by the operator to activate microswitch 77 which sets the flip-flop 78 to reset flip-flop 30 through gates 79 and 80. FF 30 clears the insert coin and coin accepted lamp conditions by disabling gates 21 and 75 and which initiates the next machine cycle.

Handle 20 (FIG. 1) is equipped with an artifical "feel" device for player appeal. The operation of the handle activates microswitch 77 to develop a high condition at output 30*a* of FF30 which is coupled to the input of 300 millisecond one-shot multivibrator 83 (FIG. 4) through inverter 84 and gate 85. The $\overline{Q}$ output of one-shot 83 resets the coins paid display visible to the machine operator on the top glass display 15 (FIG. 1); resets flip-flop 87 causing a reset of the "winner paid" condition (the "winner paid" lamp was previously extinguished by insertion of the first coin; in order to turn on the lamp, flip-flop 87 must be set and the coin counter must be on zero); and resets the SAFE "reel touch" FF441 (FIG. 3), delayed door open and delayed power failure, as will be described in more detail hereinbelow.

Bistable flip-flop 30 (FIG. 2) also prevents all further coin entry and by application of its output signal to gate 21, disables the "insert coin" signal to gate 76 to disable the "coin accepted" lamp 74. Considering also FIG. 5, the "handle" signal is applied through inverters 92 and 92*a* to the stepping motors for rotating the indicia bearing reels 21*a*–21*c*. As will be more fully described, the output of inverter 92*a* energizes transistors $Q_1$, $Q_2$ and $Q_3$ (FIG. 5) to enable the stepping motor transistors $Q_6$, $Q_7$ and $Q_8$ (FIG. 6*a*).

If desired, handle 20 may be eliminated and switch arm 94, normally coupled to +5 volts D.C. through resistor R2 (FIG. 2), may be connected to gate 53 to automatically start the reels thereby providing a handleless machine.

Figure 5:
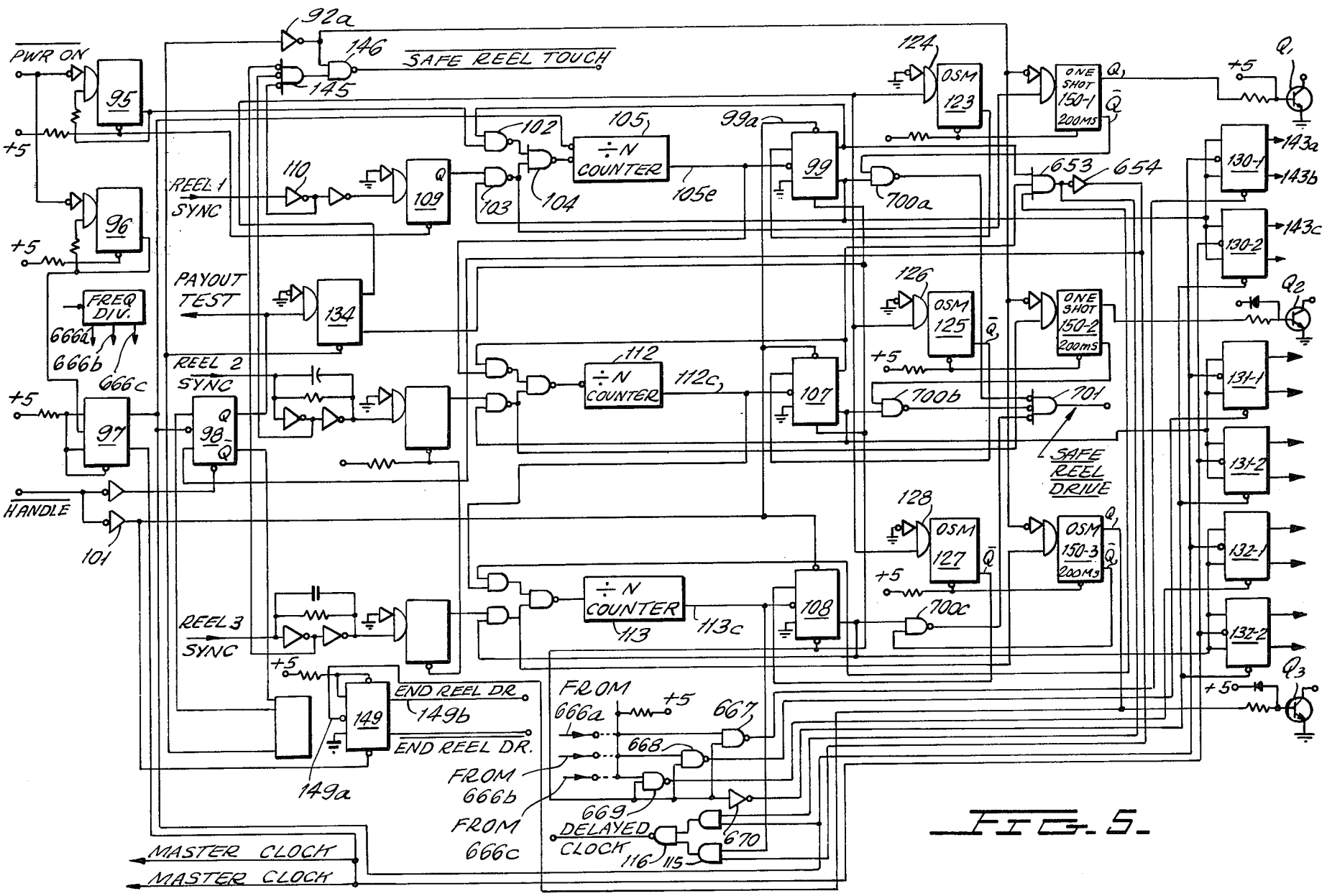

Oscillators 95 and 96 of FIG. 5 benin to operate as soon as power is applied to the machine. The high speed (100 nanosecond) oscillator 95 forms part of the random count generation, while the low speed (4 millisecond) oscillator 96 has its output applied through bistable (divider) flip-flop 97 to drive the indicia bearing reels 21*a*–21*c*. Prior to initiation of rotation of the first reel, bistable flip-flop 99 (FIG. 5) is in the set condition with its $\overline{Q}$ output high. Whenever the coin counter 28 (FIG. 2) contains a zero count, the "handle" signal is high. This condition is inverted by inverter 101 and is applied to the set input 99*a* of bistable flip-flop 99 to clamp its Q output in the high state. The Q output of flip-flop 99 is coupled to one input of gate 102, while the $\overline{Q}$ output is coupled to one input of gate 103, respectively, enabling and disabling these gates. The outputs of gates 102 and 103 are coupled to gate 104 whose output is coupled to the input of a non-resettable divide by N counter. The $\overline{Q}$ output of high frequency oscillator 95 is coupled to the remaining input of gate 102 and with gate 102 enabled, the high speed clock 95 repeatedly steps divide by N counter 105 through its N positions. When the handle is pulled, the reel drive circuits $Q_1$, $Q_2$ and $Q_3$ are enabled through the Q output of FF 97, inverter 92*a* and one-shot multivibrators 150–1 through 150–3. The clear condition is removed from bistable (FF) 106 coupled to inverter 92. The next pulse from the $\overline{Q}$ output of FF 97 (coupled to low-frequency oscillator 96) causes the Q output of FF 106 to trigger one-shot multivibrator 131 which clears FF's 99, 107 and 108 (through its $\overline{Q}$ output) and triggers one-shot multivibrators 123, 125 and 127 (through its Q output).

Figure 4:
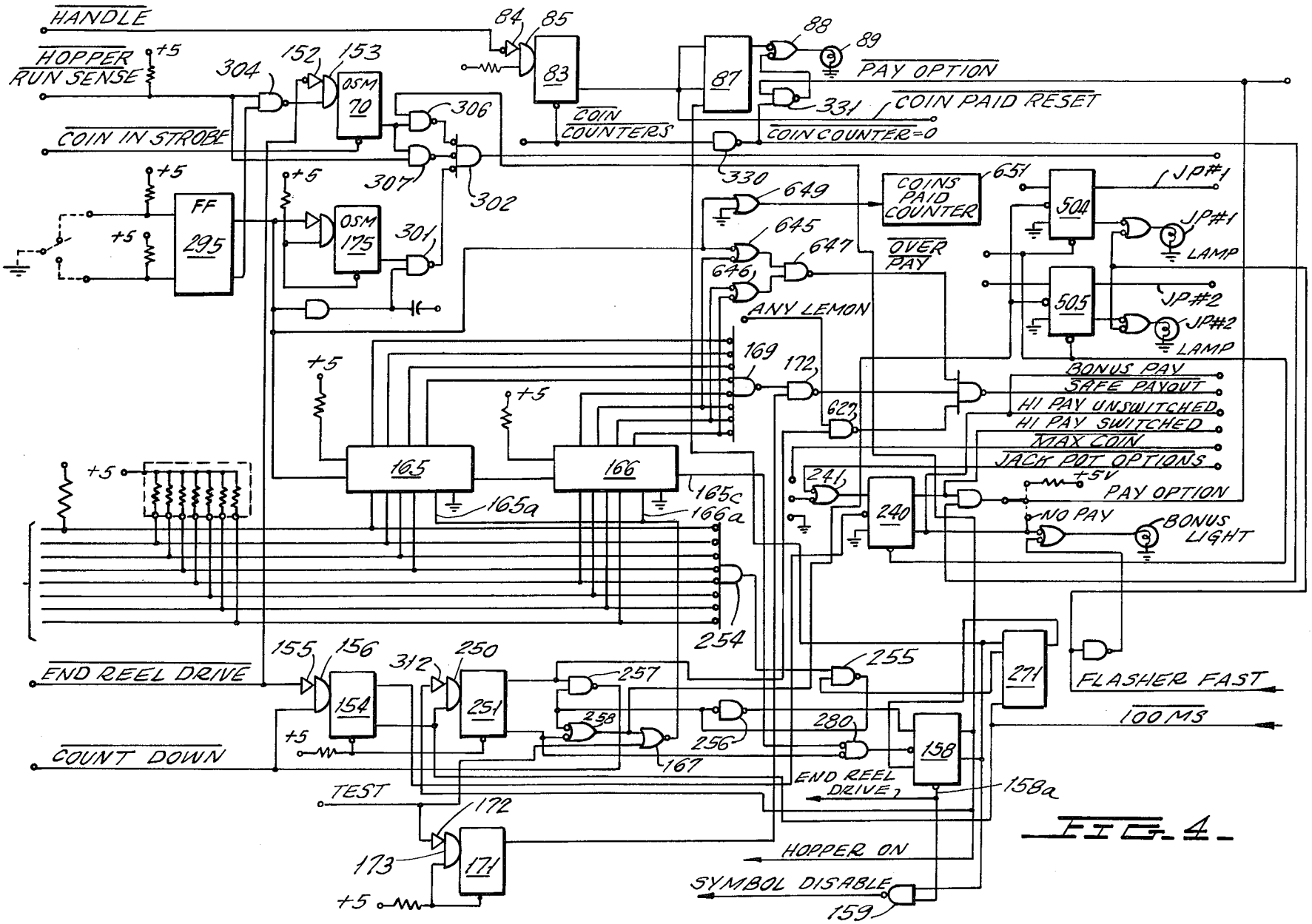

The Q output of FF 106 also generates the TEST signal which is simultaneously applied to one-shot 171 and gate 167 of FIG. 4 for a purpose to be described hereinbelow. Briefly, one-shot 171 continuously tests for payout condition while gate 167 loads contents of the all binary "ones" into counters 164 and 166 if the payout circuits are not damaged. A disable signal has been transmitted through gate 159 to the symbol decoders driving all outputs high. All pay lines should be high. All outputs of counters 165 and 166 will be high and the output of gate 169 low disabling gate 170. Any failure within the symbol payout circuitry will keep gate 170 enabled and cause a safe (unsafe) payout malfunction.

When bistable flip-flop 99 is cleared, its Q and $\overline{Q}$ outputs reverse state disabling the high speed clock input gate 102 to the divide by N counter 105. The reel #1 sync input is developed by the photoelectric means described hereinbelow. These pulses are applied to one-shot multivibrator 109, whose Q output applies the reel #1 sync pulses to counter 105 through gate 103, which has been enabled by the high level at the $\overline{Q}$ output of FF 99.

The handle pull generates the HANDLE signal which clears FF 98. On the next pulse from FF 97, FF 98 toggles to set its Q output high. When all three reels have stopped the Q outputs of FF's 99, 107 and 108 enable gate 653. The output of gate 653 is coupled to the K input of FF 98 to reset FF 98 after the reels have stopped. After FF 98 has toggled, its Q output triggers one-shot 131 which turns on FF's 99, 107 and 108 to initiate operation of the reels R (FIGS. 1 and 6*a*).

If desired, a crazy reel option may be employed to cause rotation of the reels R in either direction in a random fashion. A divide by M counter 666, employed as a frequency divider, is coupled to oscillator 96. The frequency divider 666 provides flasher outputs 666*a*–666*c* for flashing selected lamps (such as Jackpot #1 and #2, Bonus Lamp, Insert Coin Lamp, etc.) and for the "crazy" reel. The outputs 666*a*–666*c* are respectively coupled to gates 667, 668 and 669 by wiring terminals $b_2$ to $b_3$, $b_4$ to $b_5$, $b_6$ to $b_7$ by wiring $b_3$, $b_5$ and $b_7$ in common to $b_{10}$. The remaining inputs of gates 667, 668 and 669 are coupled to the $\overline{Q}$ output of one-shot 134. Depending on the state of each input 666*a*, 666*b*, 666*c* at the time that one-shot 134 develops an output pulse, the outputs of gates 667–669 are either high or low (substantially independently of one another). The outputs of gates 667–669 and inverter 670 respectively clear or fail to clear bistable FF's 130-1 to 132-2. Inverter 670 normally clears FF's 130-2, 131-2 and 132-2. Gates 667, 668 and 669 selectively clear (or fail to clear) FF's 130-1, 131-1 and 132-1 with the result that reels R may be rotated at random in either direction depending upon the state (high or low) of the outputs 666*a*–666*c* when gates 667–669 are enabled by the trigger pulse from one-shot 134.

The number that is stored in the divide by N counter 105 at the time of the handle pull determines where the reel will stop (it being noted that the number of symbol positions on the reel is preferably seven—but not necessarily—equal to the number N of the divide by N counter 105). Even with very rapid play, counter 105 will cycle through its complete count in excess of one million times between handle pulls, thereby creating a truly random number.

The output 105*c* of reel #1 counter 105 is coupled to the input 112*a* of the divide by N counter 112 for reel #2 when operating in the random mode. The output 112*c* of reel #2 counter 112 is coupled to the input 113*a* of divide by N counter 113. The output 113*c* of reel #3 counter 113 is applied to gate 115 whose output is coupled through gate 116 and gate 117 (see FIG. 3) to continually trigger and retrigger one-shot multivibrator 119 having a capability of developing a 100 millisecond pulse. If one-shot 119 fails to receive a trigger pulse at its input for 100 milliseconds, the Q output of 119 causes flip-flip 120 to be set causing its output 120*b* to enable gates 122 and 449 to respectively develop a blackout condition and a random generator condition (by turning on LED 459). While the reels are turning, the slow speed clock is continually tested by this circuit.

Simultaneously with the activation of reels 21*a*–21*c*, one-shot multivibrator 123 (FIG. 5) is triggered on for 1.1 seconds through gate 124, one-shot multivibrator 125 is triggered on for 2.2 seconds through gate 126 and one-shot multivibrator 127 is triggered on for 3.3 seconds by gate 128. These one-shots constitute "minimum run time" generators for reels 21*a*, 21*b* and 21*c* respectively. When one-shot 123 is triggered, its $\overline{Q}$ output is maintained in a low state to apply a low condition to the J input of bistable flip-flop 99 thereby preventing flip-flop 99 from changing state.

FIGS. 6*a*–6*d* show one of the reel assemblies 21 which is preferably formed of a lightweight durable plastic material and which is encoded around the periphery of disc D by a hole pattern comprised of elongated openings H. Light floods the exterior of disc D. A disc-shaped printed circuit board 140 (FIG. 6*b*) is mounted in a stationary manner within reel assembly 21 adjacent disc D. A plurality of phototransistors 140-1 through 140-10 are mounted at preset locations in a plurality of radial arrays about board 140. The symbol bearing reel R is mounted to the periphery of disc D.

A frame F supports the reel assembly and is provided with a plug connector P for electrically connecting the sensing circuits and stepper motor M to drive and control circuitry. Motor M is secured to an upright member $F_1$ of frame F (FIG. 6*c*) and its output shaft S extends through an opening in circuit board 140. Lamps Ls serve as the light source for the next adjacent reel assembly. The reel assemblies may be removed and/or replaced independently of one another. However, the interconnection arrangement for the reel connectors P and their receptacles (not shown) may be wired differently so as to create a malfunction signal (to be more fully described) in the event that the reel assemblies are not replaced in their proper positions. As the reel revolves, these phototransistors see light or dark, depending upon the hole pattern. Each symbol on reel 20 has its own three-bit binary code. Three phototransistors 140-2, 140-5 and 140-8 sense the symbol on the center line; phototransistors 140-1, 140-4 and 140-7 sense the upper symbol; phototransistors 140-3; 140-6 and 140-9 sense the lower symbol; and phototransistor 140-10 is utilized for synchronization. Although there are eight possible three-bit binary combinations, only seven of the eight are utilized and the all three dark code is employed as part of the blackout payout malfunction circuit. It should be understood that a greater or lesser number of code bits may be employed, depending only upon the number of symbols employed on each reel. For example, four bit sensing may be employed to accommodate 16 symbols, i.e. 15 active and one for malfunction detection.

Directly opposite the phototransistor 140-10 a hole $H_1$ (FIG. 6*a*) is provided in the disc D for each symbol. As reel 21 rotates, a steady stream of pulses is developed by phototransistor 140-10 to produce the "reel sync" pulses which are applied through gate 102 to trigger and retrigger the one-shot multivibrators 150-1, 150-2 and 150-3.

While the motor is running to rotate each reel, the sync pulses continually step their respective divide by N counters 105, 112 and 113, but the computer outputs are all disabled for at least the minimum run time which is controlled by one-shots 123, 125 and 127. After the minimum run time, each of the counters 105, 112 and 113 is stepped to zero to apply trigger pulses to the clock inputs of bistable flip-flops 99, 197 and 108. The Q outputs of one-shots 123, 125 and 127 cause the FF's 99, 107 and 108 to toggle to the set condition as their associated counters step to "zero", thereby stopping the respective motors (at least after the minimum run times).

Figure 6B:
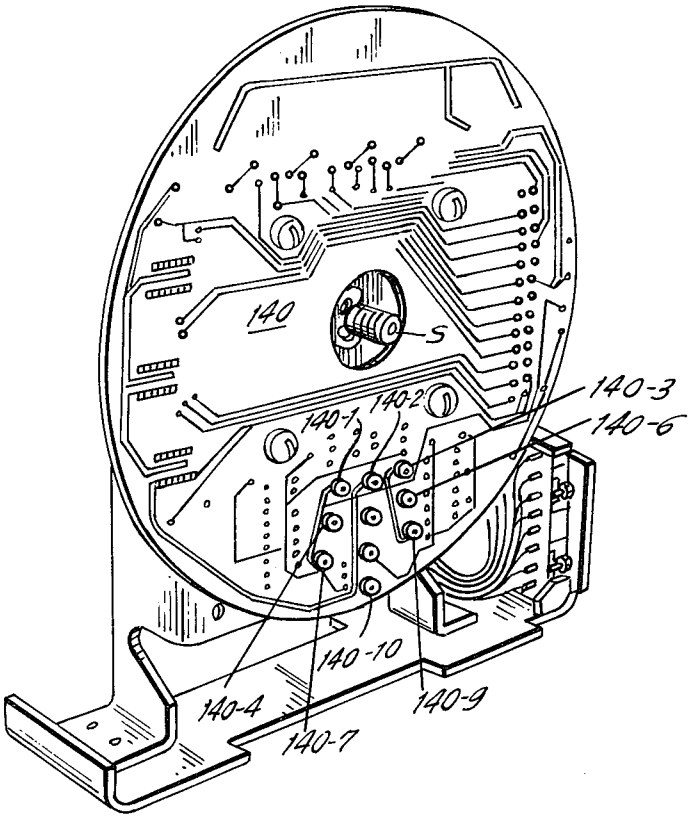
Figure 6A:
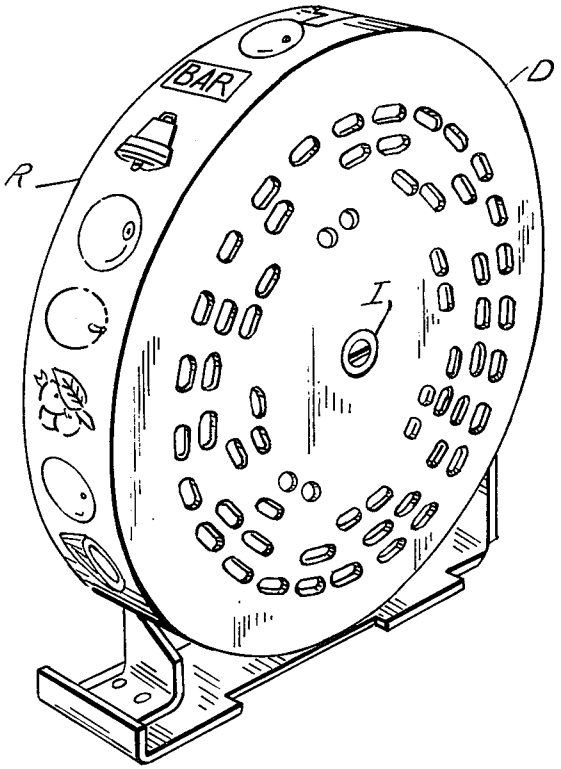
Figure 6D:
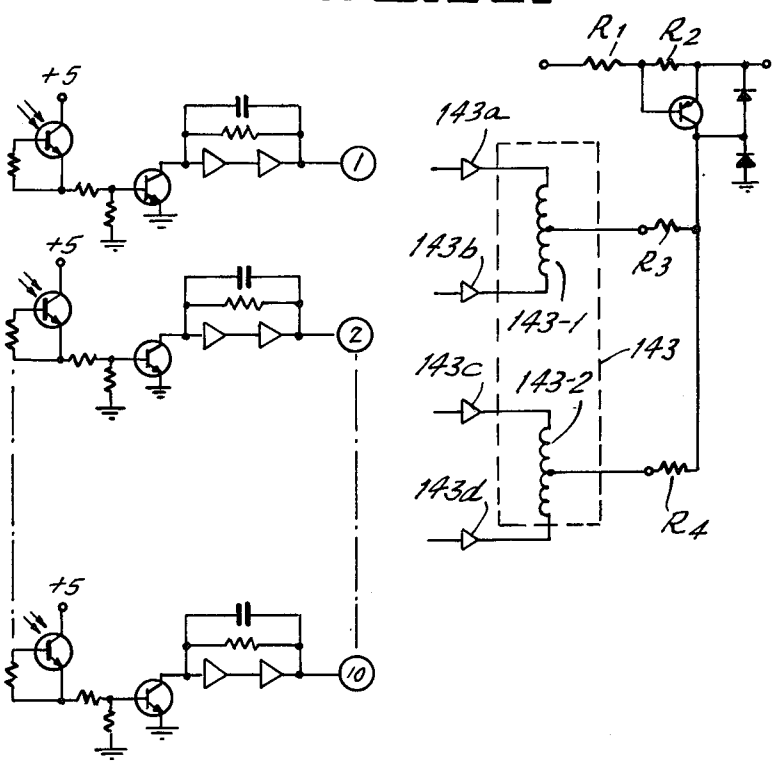
Figure 6C:
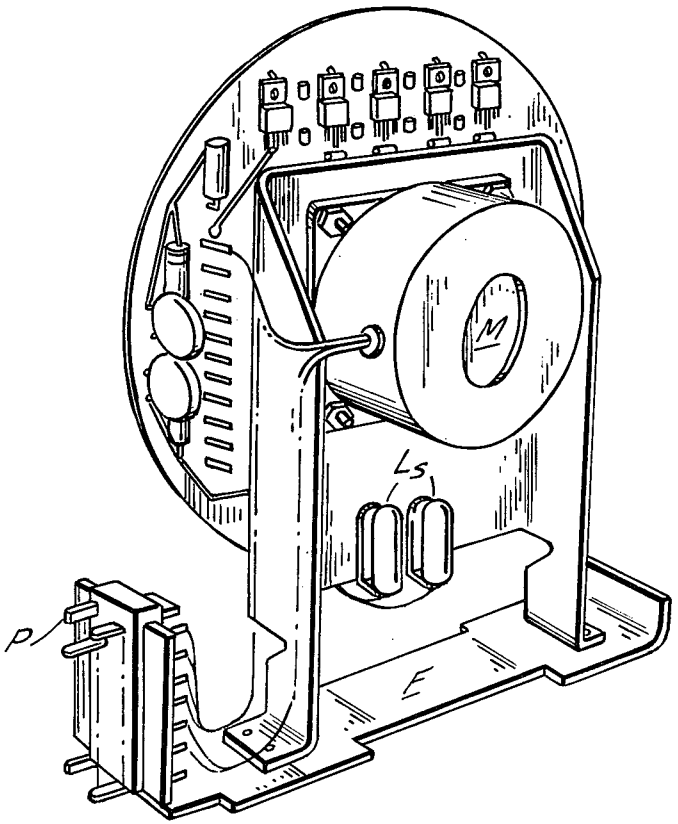

The motors are stepping motors and each of the reels are attached to the motor shaft S by a unique rubber molding process. A metallic tapped insert I (FIG. 6*a*) threadedly engages the threaded shaft S (FIG. 6*b*). A molded rubber gasket mounts disc D (and hence reel R) to insert I. Motor drive is created by the low speed clock 96 through bistable flip-flop 97 whose output is coupled to the clock inputs of bistable flip-flops 130-1, 130-2, 131-1, 131-2 and 132-1. The JK inputs of bistable flip-flops 130-1 and 130-2 are coupled in common to the $\overline{Q}$ output of bistable flip-flop 99. When the $\overline{Q}$ output is high bistable flip-flops 130-1 and 130-2 (for reel #1) are alternately set and reset by the low speed clock to apply stepping pulses to the windings of the reel #1 stepping motor 143 shown in schematic fashion in FIG. 6*d* as having a first winding 143-1 whose input terminals **143*a* and 143*b* are coupled to the Q and $\overline{Q}$ outputs of 130-1 and as having winding 143-2 whose input terminals 143*c* and 143*d* are coupled to the Q and $\overline{Q}$ outputs of 130-2. The center point of windings 143-1 and 143-2 are coupled to +28 volts through transistor Q1 and resistors R3 and R4 whenever terminal 144** receives a low condition from the collector of $Q_1$ (FIG. 5) to turn $Q_4$ (FIG. 6*d*) on. The windings 143-1 and 143-2 are alternately energized to incrementally rotate shaft S and hence reel R. The motor steps of the order of 200 times per revolution. Delay circuit 150-1 (FIG. 5) is prevented from timing out by the trigger pulses derived from gate 103. When the counter 105 resets FF 99, gate 103 is disabled and one-shot 150-1 remains on an additional 200 milliseconds before timing out. During this 200 milliseconds Q1 remains on and no steps are applied which abruptly stops motor M. The rubber insert between reel R motor shaft insert I produces a desirable "bounce" as the reel comes to a stop. Since one-shot 150-1 is turned on before FF 99 is cleared and remains on retriggered by reel sync (through gate 103) until after FF 99 is set, gate **700*a* senses this order. If one-shot 150-1 were to clear, possibly caused by lack of retrigger sync pulses, while FF 99 is in the clear motor run condition, malfunction safe reel drive is picked up through gate 701. Since a predetermined minimum number of pulses per unit are required, this circuit functions as a test of proper reel rotation speed. Gates 700*b* and 700*c* operate in the same manner as gate 700*a*. Gate 701 stores a safe reel drive malfunction in FF 406** of FIG. 3.

When the reels are not running, a circuit comprised of gates 145 and 146 (FIG. 5) is enabled. If any one of the reels is moved through an arc equivalent to one-half symbol, this condition is picked up to create the Reel Touch signal, which does not cause blackout, is reset only on handle pull, and is part of the security display to be set forth in greater detail hereinbelow. The output of gate 146 is coupled to the J input of flip-flop 441 (FIG. 3) to illuminate LED 456 through gate 446.

When all reels have stopped, one-shot 150-3 times out and its Q output (coupled to the clock input of FF 149) sets end reel drive bistable flip-flop 149 (FIG. 5) so that output **149*b* goes high. This condition initiates the pay out cycle to be described hereinbelow. When bistable flip-flop 149 is in the "clear" state, the hopper fail check comprised of one-shot multivibrator 70 (FIG. 4) receives the end reel drive condition at its trigger input through inverter 152 and gate 153. The end reel drive signal is also applied to the trigger input of one-shot multivibrator 154 through inverter 155 and gate 156 to start the payout timing cycle. The hopper bistable flip-flop 158 also receives the end reel drive signal at its clear input 158*a* so as to be enabled. The symbol recognition circuit gate 159** also receives the end reel drive signal to enable symbol recognition (to be more fully described) at this time.

Before every pay cycle (i.e. while reels **21*a*–21*c* are running), the "Test" signal goes high. This signal is applied to the load inputs 165*a* 166*a* of counters 165 and 166 through gate 167 enabling the pay out amounts to be loaded therein (as will be more fully described). At this time, however, the symbol recognition circuit is disabled. A no pay out condition causes all of the lines $2^0$ through $2^7$ (FIG. 4) to go high. Thus, counters 165 and 166 will be loaded with all binary one states causing their outputs to likewise be at the binary one condition. All these binary one conditions are applied to the inverted inputs of gate 169 causing its output to go low enabling gate 172. At the end of the reel drive, the "Test" line goes low triggering one-shot multivibrator 171 through inverter 172 and gate 173. The Q output of one-shot multivibrator 171 is coupled to one input of gate 172 which receives the output of gate 169 to test this output. If there has been a failure with the pay out circuits, the blackout-pay out malfunction condition will occur. Gate 501 (FIG. 4) generates a "safe" payout signal which is stored in flip-flop 408 (FIG. 3) whose $\overline{Q}$ output lights LED 455 through gate 445 and creates a "blackout" through gate 122. This test is performed before every pay out cycle. The end reel drive signal releases the clamp on the hopper motor flip-flop 158 (FIG. 4), enables symbol recognition by disabling gate 159 (as will be more fully described), triggers the hopper fail test one-shot multivibrator 70 and triggers pay out timer (one-shot) 154 which develops an output pulse at its Q output for a duration of 100 milliseconds. The end reel drive signal occurs 200 milliseconds after the third reel stops due to one-shot multivibrator 150 (FIG. 5). in order to allow reel #3** sufficient time to settle.

Figure 7:
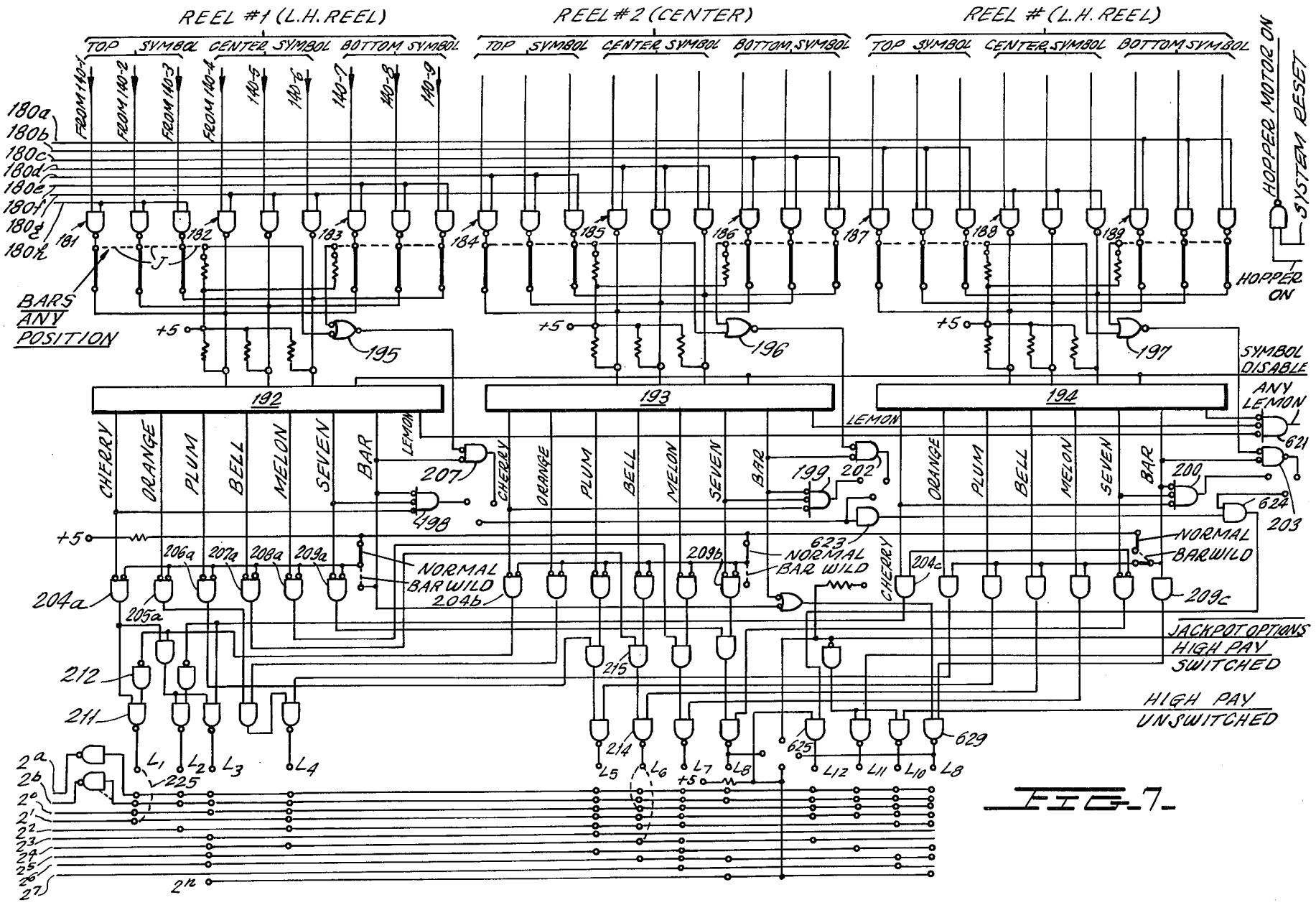

Symbol data from each of the reels is coupled to the logical circuitry of FIG. 7 in three-bit binary code form; three bits per symbol and three symbols from each reel for a total of 27 bits. For a fruit standard machine, for example, the highest code which is three holes for a bar symbol, is applied as three low states. The next highest codes, two holes and a blank, are utilized for the numeral 7, the melon and cherry symbols. A code of one hole and two blanks is used to identify bell, plum and orange symbols. A code of three blanks (all three outputs high) is not employed and, if recognized, will cause the blackout pay out condition through gate 621 which thereby indicates a "half-step" or other code malfunction. If any one of the decoders 192–194 decode this condition gate 621 will be enabled. The Q output of one-shot 251 (FIG. 4) enables NAND gate 627 to test for the above malfunction just before each payout cycle begins.

The coin counter 28 (FIG. 2) controls which of the three symbols from each reel will be displayed. The outputs of counter 28 are decoded by decoder 29 and by gates 48*a*–48*j* (FIG. 2) whose outputs are selectively coupled to lines 180*a*–180*h* of FIG. 7. For a center line pay machine, only the center symbols are enabled. However, there is a jumper option J to allow bars in any position for these machines. Thus, by coupling the outputs 181*a* through 181*c* together and 182*a* through 182*c* together, gate 195 is enabled by any "bar" position to enable gates 201, 623, 624 and 625 to provide a payout for "bars" in any position. Gates 198–200 also permit a payout for a "cherry", "seven" or "bar" in every position of the line being played when gates 198, 199 and 200 are wired to gates 623, 623 and 624 respectively. Jumper $J_2$, if wired in, permits a ∓wild bar" to increase the number of winning combinations. If a player has inserted five coins, for example, into a five line criss-cross machine, the output of coin counter 28 (FIG. 2) will be at "5" enabling gates 48*e*, 48*f* and 48*j* (FIG. 7) and initially, only the lowest symbol of reel 21*a* (line 108*e*), the center symbol of reel 21*b* (line 180*d*) and the upper symbol of reel 21*c* (line 180*b*) will be selected (i.e. enabled) wherein lines 180*b*, 180*d* and 180*f* will be high to enable the NAND gate groups 183, 185 and 187 each comprised of three NAND gates. On a multiple line machine, the symbol outputs are wire OR'd together. Negative inputs to the gates disable the outputs in this arrangement. The symbol for each reel is decoded by decoders 192, 193 and 194 associated with each of the reels 21*a*–21*c*, respectively, to cause only one of their outputs at a time to be low while the remaining outputs will all be high. When the symbol disable signal is high, all the selected outputs are high. Gates 195–197, 198–200 and 201–203 are utilized for bar symbols in any position. Gates 204*a*–209*a*, 204*b*–*209b* and 204*c*–*209c* gate the bar symbol so as to be wild with anything. In a fruit standard machine, a bar in the third reel may be wild with oranges, plums, bells and melons.

The various pay combinations are decoded and appear as a single active low state at one of the lines $L_1$ through $L_{12}$. For example, considering line $L_1$, gate 211 is coupled to the outputs of gates 204*a* and 212. Gate 204*a* decodes a cherry or a bar if the bar is wild. Gate 211 decodes a cherry or a bar if a bar is wild from the left-hand reel and no cherry on the center reel which constitutes a win condition to develop a low at line $L_1$. As another example, consider a line $L_6$. Gate 214 is low when gates 215 and 2-7*c* (from reel #3) are high. Gate 215 decodes either a bar or a bell from the center reel through gate 217 and a bell from the left-hand reel through gate 207*a*. Gate 207*c* decodes either a bell or a wild bar. These conditions thus develop a low signal at output $L_6$. Low outputs at $L_2$–$L_5$ and $L_7$–$L_{12}$ are derived in a similar fashion. As another example, on a fruit standard machine, a cherry on the left-hand reel and no cherry on the center reel will cause $L_1$ to go low and all other L lines will be high. $L_2$ and $L_3$ pay on two cherries and three cherries respectively (left-center and center-right); $L_4$ pays on three oranges; $L_5$ pays on three plums; $L_6$ pays on three bells, $L_7$ pays on three melons, $L_9$ pays on three 7's; $L_8$ pays on three bars, and so forth. The L lines are left open or wire jumpered or diode jumpered to lines $2^a$, $2^b$, and $2^0$ through $2^7$. The lines $2^0$ through $2^7$ of FIG. 7 are connected respectively to the lines $2^0$ through $2^7$ of FIG. 4. Because of the pay out method employed, actual pay out will be one more coin than the binary number selected. For example, on fruit standard machines, three bells or two bells and a bar will produce a low at line $L_6$. This line is electrically connected to the $2^4$ and $2^0$ lines as shown by dotted line jumpers 223 and 224 in FIG. 7. These lines add up to decimal 17. The $2^4$ and $2^0$ lines are coupled to pay out counters 165 and 166 respectively. Actual pay out will be 18 coins in number. As a further example, if line $L_1$ is connected to the $2^1$ line as shown by dotted line jumper 225 in FIG. 7, this is connected through the $2^1$ line of FIG. 4 to pay out counter 165 to pay three coins.

For high pay outs on some machines, there is provision for either a partial drop or no drop and as an alternative, an "attendant pay" is provided. In one multiple coin machine, one non-linear high pay may be offered when the maximum number of coins has been played and the highest award is hit. This condition sets "bonus" flip-flop 240 as shown in FIG. 4 by application of a "jackpot option" input to gate 241 which, in turn, applies its output to the J input of bistable flip-flop 240. The jackpot option signal may be derived from a gate output, typically the gate which decodes "777". Jackpot option is directly connected to the gate output line $L_9$ which is typically 777. Lines $2^a$ and $2^b$ are also connected to gate outputs typically 777 and Bar-Bar-Bar, i.e., to outputs $L_9$ and $L_8$. If the player scores 777 and has inserted the maximum number of coins (by connecting a jumper across $d_2$ and $d_1$) gate 241 is enabled; its output goes high and bonus flip-flop 240 is set. Depending on the options selected this may give a partial pay or no pay and may lock the machine in an unplayable "option" mode previously described. A flashing "bonus" light comes on. Flip-flops 504 and 505 provide two levels of jackpot indications. Bonus and both jackpots are sensed by the computer by lines BONUS PAY, JP#1 and JP#2. Flashers for bonus and jackpots are opposite phase so that the lamps are illuminated in alternating fashion. Typically $2^a$ by itself indicates 777 and $2^b$ would indicate Bar Bar Bar, and not maximum coins, both of which are automatically paid by machine. Thus the "bonus" condition gate 629 (FIG. 7) is enabled for three "sevens", connecting its output line ($L_8$) jumper $j_3$ to $j_1$ and $j_4$ activates line $2^n$ and the $\overline{\text{JACKPOT OPTIONS}}$ signal line. FF 240 is thus enabled to enable gate 630. A fast flasher source 666 described hereinabove applies repetitive pulses from one of its inputs 666*a*–666*c* to gate 630 through gate 631 to flash the BONUS LAMP 632. The J inputs of FF's 504 and 505 are wired to $2^a$ and $2^b$ lines (FIG. 7) to provide one or two jackpots. The gates 634 and 635, coupled to the $\overline{Q}$ outputs of 504 and 505 are enabled to respectively flash the Jackpot #1 and Jackpot #2 lamps 637 and 638.

When the count in coin counter 28 (FIG. 2) goes to zero, this condition is applied to bistable flip-flop 30–31 to reset the flip-flop which, in turn, resets the reel drive circuits to terminate the pay cycle circuits. The last 100 millisecond pulse after the coin counter 28 is decremented to zero clears the static eliminator flip-flop 25 through gates 27 and 26 (FIG. 2).

If any of the pay lines $2^0$ through $2^7$ are low (FIG. 4) the output of gate 254 will be high. This causes gate 255 to develop a high output because the 100 millisecond pulse clears the bistable flip-flop comprised of cross-coupled gates 271 and 272. The output of gate 272 is coupled to the remaining input of gate 255 to cause the output of gate 255 to go low disabling gate 257 and enabling gate 258. At this time the 10 millisecond pulse from one-shot 251 will not be fed back to one-shot 154, but will load pay out counters 165 and 166 through gate 167. The trailing edge of the $\overline{Q}$ output of one-shot 251 is coupled through gate 280 to the clock input of the hopper bistable flip-flop 158 which causes its Q output to go high to develop the hopper on signal. This signal energizes the hopper motor to eject coins. As the coins are dispensed, they pass a coin-out microswitch 292, shown in FIG. 4, which toggles the bistable flip-flop 295. With the passage of each coin, pulses appear at the Q output of bistable flip-flop 295 to increment pay out counters 165 and 166, as well as the electromechanical counter on the top display. This signal also goes to several fail-safe circuits. Once the counters 165 and 166 are incremented so as to have all binary one conditions at their outputs, the next pulse comes through as a carry signal at the carry output 166*c* of pay out counter 166 which is applied through gate 280 to the bistable flip-flop 158 causing this flip-flop to be toggled to the off condition. Because of this technique, the counter had been previously set to one less than the actual pay out when the carry pulse represents the last unit count of the pay out. If the hopper attempts to output another coin the Q output of FF 295 enables gate 645. Gate 645, together with gate 646, senses all zeros in counter 166 (in the three most significant bit positions), to enable gate 647, creating an OVERPAY malfunction signal. Counters 165 and 166 have a minus pay out insert and then count up towards zero. However, a zero (0) count constitutes a full pay out so that stepping to a "plus-one" (+1) count indicates an "over-pay" condition.

If the hopper-coin-out microswitch 292 jams for 300 milliseconds, one-shot multivibrator 175 will cause a blackout-hopper malfunction through gates 301 and 302. Bistable flip-flop 70 (FIG. 4) is triggered by an end reel drive signal through gates 152 and 153. The hopper run sense signal enables gate 304 and the coin output continually retriggers this stage by way of the $\overline{Q}$ output of bistable flip-flop 295 applied to the other input of gate 304. Loss of hopper current or a 5 second no coin output, i.e. the hopper is jammed or empty, when the hopper is on (i.e. Q output of FF 158 is high) will cause a blackout-hopper malfunction enabling gates 306 and 307. Also, if the hopper is still on (Q output of FF 158 high) gate 307 will enable gate 302 to create the hopper malfunction signal. In addition, if hopper motor current is sensed and one-shot multivibrator 70 is not triggered, blackout hopper malfunction will occur. These conditions are derived through gates 306, 307 and 301 which feed gate 302 for developing the hopper malfunction signal. Gate 649 receives each up-count pulse applied to counter 165 to step a coins paid counter 651.

When the hopper turns off, the Q output of bistable flip-flop 158 is applied through inverter 312 and gate 250 to one-shot multivibrator 251 to initiate a 10 millisecond pulse. Since bistable flip-flop 271 has been set by the $\overline{Q}$ output of the hopper bistable flip-flop 158, gate 255 which is coupled to the output of cross-coupled gated 272 enables gate 257 to couple the 10 millisecond pulse through the count down line to coin counter 28 to decrement this counter and to retrigger one-shot multivibrator 154. Whenever the hopper bistable 158 turns on, its $\overline{Q}$ output is coupled to bistable flip-flop 87 (FIG. 4) to toggle this bistable flip-flop. When the coin counter 28 (FIG. 2) goes to zero, this condition is coupled through gates 330 and 331 to the remaining input of gate 88 to illuminate the winner paid lamp 89.

In addition to the bonus (attendant pay) lamp, there are two levels of jackpot which are picked up as a function of jumper wiring. The outputs go to lamps and to the computer interfaces.

Figure 3:
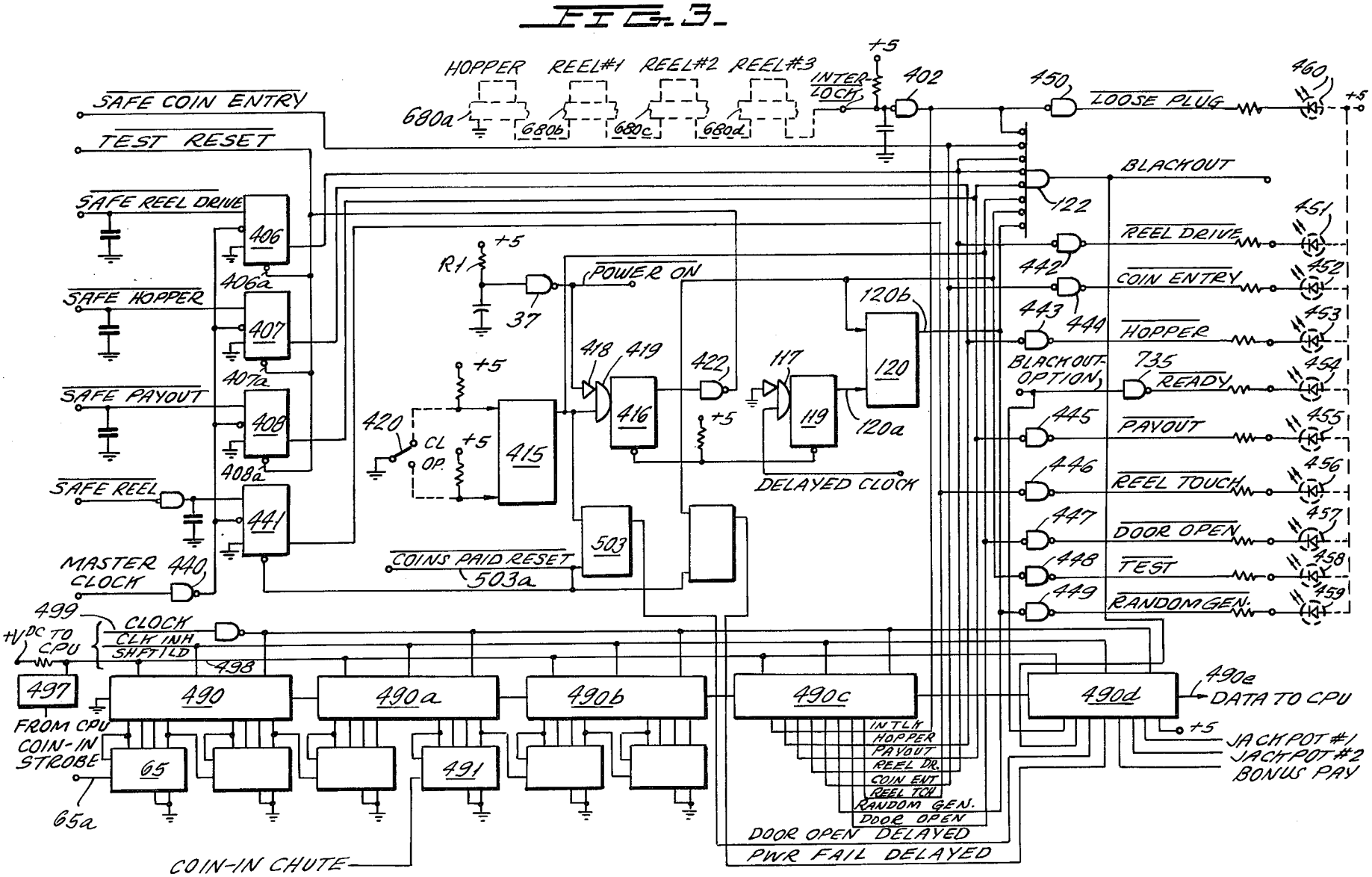

Information as to the various causes for failure is stored in bistable flip-flop circuits shown in FIG. 3. Considering gate 122 of FIG. 3, blackout may be caused by a loose or improperly located plug condition detected by the output of gate 402; a coin entry failure derived from the $\overline{Q}$ output of bistable flip-flop 405, as shown in FIG. 2, a reel drive failure derived from the $\overline{Q}$ output of bistable flip-flop 406; a hopper failure derived from the $\overline{Q}$ output of bistable flip-flop 407; a pay out failure derived from the $\overline{Q}$ output of bistable flip-flop 408; a random generator failure derived from the Q output of bistable flip-flop 120; a door open condition derived from the Q output of bistable flip-flop 415; or a one second test condition derived from the $\overline{Q}$ output of one-shot multivibrator 416. Closing the door or applying power to the machine starts the one second test period. For example, when power is applied, one-shot multivibrator 416 is triggered through gate 37 and gates 418 and 419 to begin the one second test. Door closure activates a microswitch 420 to set bistable flip-flop 415 whose output is coupled to gate 419 thereby triggering one-shot multivibrator 416 to begin a 1 second test. The one second test causes the Q output of one-shot 416 to go high. Gate 422 develops a test reset signal which is applied as a clear input signal at the clear inputs 406*a*, 407*a* and 408*a* of bistable flip-flops 406-408 respectively. If the malfunction condition is still present, the appropriate flip-flop will again set immediately after the 1 second test again causing a failure condition.

The plug connectors P (FIG. 6*c*) of each reel assembly and the hopper connector are uniquely wired so as to complete a circuit with their receptacles 680*a*–680*d*. When properly assembled the completed circuit path places a low level on the input of inverter 402. The output of inverter 402 goes high. This state drives the output of gate 450 high to extinguish the "loose plug" LED 460. In the event that any of the hopper or reel assembly plugs are loose, or if the reel assemblies have not been replaced in their correct arrangement, LED 460 is lit. The output of gate 402, which is low at this time, is further connected to the inputs of gate 122 and one stage of counter 490 to respectively create a BLACKOUT signal and storing the loose plug condition in the polling register 490.

The above listed eight conditions plus the conditions of "reel touch" and "ready" are routed to a light emitting diode (LED) display contained within the machine housing 11 (FIG. 1). As soon as the 1 second period is terminated, the next master clock pulse is applied through gate 440 to each of the clock inputs of bistable flip-flops 406–408 and 441 to load the malfunction condition into the respective one or ones of these bistable flip-flops which cause gate 122 to develop the blackout condition which cause a respective one of the gates 442–450 to illuminate the appropriate LED 451–460 respectively. The blackout condition turns off all coin lamps as can best be seen from FIG. 1 wherein the blackout signal is applied through gate 470 to each of the coin lamp gates 473–477 to extinguish the lamps of lamp group 62. This information, however, is not lost. The blackout condition further forces the static clamp of bistable flip-flop 25 into the on condition through gates 24 and 26 to apply a signal to the clear input 25*a* of bistable flip-flop 25. This prevents the machine from being played, prevents any coin entries, and turns malfunction lamp 482 on. Noting FIG. 2, the blackout signal is applied to one input of gate 483 whose other input receives a low frequency signal from oscillator 484 to flash lamp 482 which is positioned behind the top display panel 15 (FIG. 1). The coins paid counter, however, is not reset.

All status, malfunction and counter information is presented to a multi-bit parallel entry register 490, shown in FIG. 3. As was described hereinabove, the coin-in strobe pulses of step counter 65 to develop a count representative of the number of coins deposited in the machine. Counter 491 receives a coin-in chute pulse to develop a count representative of the coins deposited in the drop box. The outputs of counters 65 and 491 and the inputs to each of the gates 442–450 are applied to selected stages of the multi-stage shift register 490. In addition, the conditions of jackpot #1, jackpot #2, bonus pay, power fail delayed, door opened delayed, blackout and blackout/option conditions are applied to the remaining inputs of shift register 490. The particular address of the slot machine is decoded by logical circuitry 497. The computer polls each machine by placing the address of each machine on the line to which the machines are daisy-chained. The decoder 497 operates to alter the level on the SHIFT/LOAD line 498. This line is normally at the LOAD level, enabling whatever appears at the inputs of shift registers 490–490*d* to be loaded into these registers.

When the address of the machine is decoded at 497, the level on line 498 changes to the SHIFT level causing all inputs loaded into 490–490*d* to be frozen. The computer then removes the clock inhibit level from line 498*a* allowing the pulses applied by the computerclock source on line 499 to shift the contents of register 490–490*d* to the right and into the line 490*e* coupled to the computer. After all the data has been transferred to the computer, the computer loads it in its memory and puts the address of the next machine on the input line to all of the machine decoders 497, whereupon the next machine transfers its data to the computer in a similar fashion. The computer then is free to manipulate, display and/or print out pertinent data.

What is claimed is:

1. Apparatus for stepping a movable display means to one of N possible positions in a random fashion comprising:

multi-stage counter means;

free-running high frequency and low frequency generating means;

selection means for initiating a selection operation signal;

gate means;

bistable circuit means having set and reset states being normally in said set state and responsive to said selection signal to be reset;

first gating means responsive to said bistable circuit means for coupling said high frequency generating means to said counter means only when said bistable circuit means is in the set state to cause said counter means to be repeatedly stepped through its maximum capacity at an extremely high rate, and to disconnect said high frequency generator means from said counter means when said bistable circuit means is reset whereby the count then in said counter determines the final positon of the display means;

means for driving said display means in a stepwise manner;

second gating means for coupling said low frequency generating means to said stepping means when said bistable means is reset;

sensing means responsive to movement of said display means for generating pulses;

third gating means for coupling the output of said sensing means responsive to the stepping of said counter means from the count presently in the counter means to a predetermined count to disable said second gating means to stop said display means at the position related to the count stored in said counter when said first gating means was disabled.

2. The apparatus of claim 1 further comprising delay means triggered by said selection signal to prevent said bistable means from being reset until a predetermined delay period has expired.

3. The apparatus of claim 1 further comprising a coin slot;

means responsive to deposit of a coin in said coin slot for incrementing a counter;

means responsive to a count in said counter greater than zero for activating said selection means.

4. Apparatus, comprising:

a plurality (K) of rotatable display means each having a plurality (N) of symbols around their peripheries;

a plurality (K) of means for incrementally stepping each of said display means;

a plurality (K) of counter means associated with each display means and arranged in tandem fashion;

a plurality (K) of bistable means each being coupled to the output of an associated counter means and each having set and reset states;

selection means operable for generating a selection signal to reset all of said bistable means;

a free-running high frequency signal generator;

a plurality (K) of gate means wherein a first one of said gate means couples the output of said signal generator to a first one of the counter means and the remaining (K-1) gate means couples the output of each counter means to the input of the next counter means only when the bistable means associated with each counter means is in the set state;

a low frequency signal generator;

means responsive to bistable means being reset by said selection signal for enabling said stepping means to be operated by said low frequency signal generator;

a plurality (K) of means for sensing the movement of each of their associated display means and for generating stepping pulses;

a second plurality of K gate means for coupling said stepping pulses from their sensing means to their associated counter means only when their associated bistable means have been reset;

said bistable means being set by their associated counters reachig a count of zero to disable said second plurality of gate means and thereby terminate stepping of said stepping means to stop said display means.

5. The apparatus of claim 4 further comprising a plurality (K) of delay means each being triggered by said selection signal to prevent their associated bistable means from being set until the termination of the delay period of each delay means.

6. The apparatus of claim 4 wherein each of said movement sensing means comprises lamp means;

a plurality of openings provided at spaced intervals about said display means;

sensing means for sensing the passage of light through each opening to generate stepping pulses.

7. The apparatus of claim 4 wherein each of said display means is provided with a plurality of symbols arranged at spaced intervals;

a coded pattern associated with each symbol;

means for sensing each coded pattern to convert the sensed coded pattern into binary signals representing the sensed code;

means responsive to the termination of rotation of all of said display means for decoding the binary signals of all K display means to determine the symbols in the display position;

means responsive to the decoding means for generating a count;

payout counter means for storing said count;

a coin bin for storing coins;

a coin hopper;

means responsive to a count in said payout counter means for dispensing coins from said coin bin into said hopper;

coin sensing means responsive to the passage of each coin into said hopper for reducing the count in said payout counter;

means responsive to a zero count in said payout counter means for disabling said dispensing means.

8. The apparatus of claim 7 further comprising:

winner sensing means coupled to said payout counter means for developing a winner signal whenever the count in said payout counter means is greater than zero;

hopper bistable means being set by said winner signal;

delay means coupled to coin sensing means for generating a delayed output signal when the time duration between coin dispensing signals is greater than the delay time of said delay means;

means responsive to the presence of a delayed output signal and the set state of said hopper bistable means for generating a coin hopper malfunction signal.

9. The apparatus of claim 7 further comprising plural means each adapted to sense a malfunction condition;

register means having a plurality of stages for storing the states of said plural malfunction sensing means;

means for loading the contents of said sensing means into a first group of selected stages of said register means;

an input line and an output line;

decoder means responsive to a code applied to said input line for sequentially stepping the contents of said register means into said output line.

10. The apparatus of claim 9 further comprising first totalizer means for counting the total number of coins deposited in said bin;

second totalizer means for counting the number of coins dispensed into said hopper;

means for loading the contents of said first and second totalizer means into a second group of selected stages of said register means.

11. The apparatus of claim 4 further comprising:

delay means triggered by said stepping pulses, said delay means being adapted to time out if the time duration between stepping pulses exceeds the delay period of said delay means.

12. Apparatus, comprising:

a plurality of individual reel assemblies, each of said assemblies being comprised of:

a support frame;

a stepping motor mounted upon said frame and having an output shaft;

a disc mounted for rotation on said shaft, said disc having a plurality of symbols thereon;

a hollow cylindrical member mounted to the periphery of said disc;

means operable for activating said apparatus;

random high frequency generator means;

low frequency stepping means;

counter means normally stepped by said random generator means;

means for decoupling said random generator means from said counter means and for coupling said low frequency stepping means to said counter means and said motor when said activating means is operated;

means responsive to a predetermined count in said counter means for decoupling said low frequency stepping means from said motor and for abruptly halting said motor.

13. The apparatus of claim 12 further comprising a circuit board secured to said frame on one side of said disc;

a light source mounted to the other side of said disc;

a plurality of light sensing devices mounted on said circuit board;

a plurality of patterns of openings on said disc each being associated with one of said symbols whereby said light sensing devices are selectively illuminated by said light source to generate electrical signals representing the symbol being displayed when said reel assembly is halted.

14. The apparatus of claim 13 further comprising decoder means coupled to the sensing device of said reel assemblies for determining the combination of symbols being displayed when all of said reel assemblies have stopped rotating.

15. The apparatus of claim 14 further comprising means for decoding the failure of all of the sensing devices on any of said reel assemblies from being illuminated to indicate a malfunction signal due to misalignment of the reel stopping.

16. The apparatus of claim 13 wherein said opening pattern includes at least one timing hole for each symbol position on said reel;

said sensing means further including means adapted to generate a pulse as each timing hole passes the sensing means;

delay means coupled to said timing hole sensing means for timing out only when the interval between successive pulses from said timing hole sensing means exceeds the delay period of said delay means;

means coupled to said delay means for generating a malfunction signal whenever said delay means times out.

17. The apparatus of claim 12 further comprising means coupled between said stepping means and said motor means for randomly controlling the direction of rotation of said reels.

18. The apparatus of claim 12, wherein each reel assembly further comprises a connector plug having a plurality of pins;

a plurality of receptacles each adapted for receiving an associated one of said connector plugs and having a socket for each of said pins;

means for establishing one circuit path when all of said plugs are properly inserted into their associated sockets;

means responsive to the absence of said circuit path for generating a malfunction signal indicating improper insertion of said plugs in said sockets.

19. The apparatus of claim 12 further comprising delay means triggered by said stepping means for generating a malfunction output if said delay means times out before receipt of any trigger pulse from said stepping means.

20. The apparatus of claim 12 further comprising delay means coupled to the output of said counter means and to the output of said activating means for generating a malfunction signal when said activating means has not been operated and the interval between successive outputs from said counter means exceeds the delay period of said delay means.

21. A gaming machine comprising:

a plurality of reel assemblies each having a rotatable reel and a motor drive therefore;

a plurality of counter means for each reel assembly and being connected in a cascade array;

a high frequency stepping means for incrementing the first counter means in said array whereby each succeeding counter means is incremented each time the immediate preceeding counter means reaches a capacity count;

low frequency stepping means responsive to receipt of a coin for coupling said low frequency stepping means to all of said reel assemblies and for decoupling said high frequency stepping means from said first counter means;

means provided in each reel assembly for sensing the rotation of its associated reel to generate stepping pulses and applying said stepping pulses to its associated counter means;

means coupled to each counter means responsive to development of a capacity count therein to decouple said low frequency stepping means from the associated reel assembly;

delay means coupled to the last counter means in said array for receiving trigger pulses therefrom each time said last counter means reaches a capacity count;

means coupled to said delay means for generating a high frequency stepping means malfunction signal when the interval between trigger pulses applied to said delay means is greater than the delay period of said delay means.

22. The gaming machine of claim 21 further comprising a tamper proof housing for enclosing the machine and reel assemblies;

a door swingably coupled to said housing for gaining access to the housing interior;

key operated lock means for locking said housing door in the closed position;

switch means responsive to the opening of said door for generating a door open signal.

23. The gaming machine of claim 22 further comprising malfunction signal storage means for storing said door opening signal.

24. The gaming machine of claim 23 further comprising lamp means coupled to said malfunction signal storage means and being illuminated when a door-open signal is stored therein.

* * * * *

UNITED STATES PATENT AND TRADEMARK OFFICE

CERTIFICATE OF CORRECTION

PATENT NO. : 4,099,722

DATED : July 11, 1978

INVENTOR(S) : Rodesch et al.

It is certified that error appears in the above-identified patent and that said Letters Patent are hereby corrected as shown below:

Column 3, Line 56, the word "plus" should read --plug--

Column 8, Line 56, the word "benin" should read --begin--

Column 9, Line 25, the numeral "164" should read --165--

Column 11, Line 16, after the word "four" insert --(4)--

Line 17, change "16" to read --sixteen (16)--

Line 17, change "15" to read --fifteen (15)--

Column 11, Line 28, the word "computer" should read --counter--

Column 13, Line 41, the symbol "∓" should be changed to --"--

Column 13, Line 47, "108e)" should read --180e)--

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*